US009777984B1

(12) United States Patent
Bonine

(10) Patent No.: US 9,777,984 B1
(45) Date of Patent: Oct. 3, 2017

(54) SKELETONIZED GRIP FOR AN AUTOMATIC RIFLE HAVING INTERCHANGEABLE GRIP PANELS

(71) Applicant: David Kristopher Bonine, Grants Pass, OR (US)

(72) Inventor: David Kristopher Bonine, Grants Pass, OR (US)

( * ) Notice: Subject to any disclaimer, the term of this patent is extended or adjusted under 35 U.S.C. 154(b) by 0 days.

(21) Appl. No.: 15/200,941

(22) Filed: Jul. 1, 2016

Related U.S. Application Data

(60) Provisional application No. 62/194,514, filed on Jul. 20, 2015.

(51) Int. Cl.

| | |
|---|---|
| ***F41C 23/00*** | (2006.01) |
| ***F41C 23/16*** | (2006.01) |
| ***F41C 23/18*** | (2006.01) |
| ***F41C 23/22*** | (2006.01) |

(52) U.S. Cl.
CPC ..... *F41C 23/16* (2013.01); *F41C 23/18* (2013.01); *F41C 23/22* (2013.01)

(58) Field of Classification Search
CPC ..... F41C 23/14; F41C 23/10; F41C 23/16
USPC ..... 42/71.01, 71.02
See application file for complete search history.

(56) References Cited

U.S. PATENT DOCUMENTS

| | | | | |
|---|---|---|---|---|
| 5,469,601 | A | 11/1995 | Jackson | |
| 6,802,148 | B1 | 10/2004 | Danas | |
| 7,287,455 | B2 * | 10/2007 | Key-Carniak | F41C 23/10 42/71.02 |
| 7,587,852 | B1 | 9/2009 | Harms | |
| 7,845,105 | B1 | 12/2010 | Cahill | |
| 8,156,677 | B2 | 4/2012 | Glock | |
| 8,490,311 | B2 | 7/2013 | Hogue | |
| 8,584,390 | B1 * | 11/2013 | Fraher | F41C 23/10 42/71.02 |
| 2006/0096147 | A1 | 5/2006 | Beretta | |
| 2010/0139144 | A1 | 6/2010 | Fitzpatrick et al. | |
| 2010/0212202 | A1 * | 8/2010 | Roth | F41C 23/10 42/71.01 |
| 2012/0055060 | A1 | 3/2012 | Hines et al. | |
| 2013/0205635 | A1 | 8/2013 | Hines et al. | |
| 2016/0010945 | A9 * | 1/2016 | Ermossa | F41C 23/10 42/69.01 |
| 2016/0202018 | A1 * | 7/2016 | Bruhns | F41C 23/10 42/71.01 |

(Continued)

*Primary Examiner* — J. Woodrow Eldred
(74) *Attorney, Agent, or Firm* — Jerry Haynes Law

(57) ABSTRACT

A grip for an AR-10 and AR-15 automatic rifle comprises a skeletonized frame that mates with the receiver of the automatic rifle. The skeletonized frame includes a plurality of frame members that interconnect at angles to reinforce the structural integrity of the frame. The skeletonized frame comprises an open area. The open area stores items pertinent to operation of the automatic rifle. The frame is also configured to receive multiple interchangeable grip panels for altering the visual and functional aspects of the grip. The interchangeable grip panels detachably recess into an appropriate section of the frame, such that their edges are protected from damage from inadvertent impact and abrasion. For example, the grip panels provide a texture that helps cushion the palm of the hand, or accommodate left hands and/or right hands. The panels align through an alignment pin that passes through the opening of the frame.

20 Claims, 5 Drawing Sheets

(56) References Cited

U.S. PATENT DOCUMENTS

2017/0108301 A1* 4/2017 Murphy, II ..... F41A 17/066

* cited by examiner

SKELETONIZED GRIP FOR AN AUTOMATIC RIFLE HAVING INTERCHANGEABLE GRIP PANELS

CROSS-REFERENCES TO RELATED APPLICATIONS

This application claims priority from U.S. Provisional Application Ser. No. 62/194,514, entitled "Skeletonized Grip for an Automatic Rifle Having Interchangeable Grip Panels", filed on Jul. 20, 2015, which application is hereby incorporated herein by reference in its entirety.

FIELD OF THE INVENTION

The present invention relates generally to a grip having interchangeable grip panels. More so, the present invention relates to a grip for an automatic firearm, wherein the grip comprises a skeletonized frame and interchangeable grip panels for altering the visual and functional aspects of the grip.

BACKGROUND OF THE INVENTION

Many types of grips have been devised for attachment to firearms or pistols to enable a user to better hold and aim the firearm, or to reduce recoil or otherwise improve the comfort when the firearm is held and fired with consistent accuracy. The use of elastomers in the grip assembly provides for a better "feel" in the user's hand and may provide a certain amount of bulk or sizing to otherwise standard factory produced grips.

People naturally have different sizes and shaped hands. Pistols, rifles and revolvers are, however, normally manufactured and sold with only one size, shape, and style of a firearm grip portion. Consequently, there is a substantial probability that the firearm that an individual purchases will not have a grip that properly fits that person's hand. An improper size, shape, and style of firearm grip portion can make the firearm uncomfortable to shoot, make it difficult to shoot accurately and can even make it unsafe to handle or to draw from a holster. In addition, individuals have their own preferences when it comes to the construction of a firearm/handgun grip. Some individuals will want a comparatively soft grip portion that has some give to it and yet other individuals will prefer a more rigid grip. In a similar manner, individuals have their own preferences when it comes to the type of external surface of a firearm/handgun grip. Some individuals will want a comparatively smooth grip portion and yet other individuals will prefer a grip that has checkering or the like on the grip surface that provides friction between the hand and the grip. Other advanced shooters may have a preference for a particular style or configuration of the grip portion. These present problems are greatly compounded, in those instances when firearms are purchased for use for multiple users such as for police departments or other law enforcement agencies where it is to be expected that there will be multiple users for the firearm during its service life.

The grips for firearms, hereinafter often in brief referred to as "rifles", without the invention being limited to these weapons, serve to provide a solid grip for marksmen and to dampen the impact to the hand and, where applicable, the arm of the marksman when a shot is fired. As different users have different shapes of hands, there is a need to equip weapons with a range of grips. Firearm grips may even be specifically designed for competitive marksmen and special units, and modified for each marksman.

It is common practice for hand weapons, in particular to have a multipart grip, whereby the individual part can be exchanged for differently shaped and designed parts and/or parts of different sizes, to make the weapon suitable for users with different hand shapes.

Numerous innovations have been provided in the prior art which are adapted to a grip for a rifle having interchangeable grip panels. Even though these innovations may be suitable for the specific purposes to which they address, however, they would not be as suitable for the purposes of the present invention.

For example, U.S. Pat. No. 6,802,148 to Danas describes a grip for a firearm comprising insertable and removable trigger finger support inserts for a side panel of the grip for more shooting accuracy and consistency.

U.S. Pat. No. 7,845,105 to Cahill discloses a grip panel attached to a firearm accessory rail for attaching a pressure switch. The grip comprises removable interchangeable sliding or other type locking inserts that trap and fasten switches for firearm accessories such as white lights, lasers, invisible lasers, and communication devices to the host firearm.

U.S. Pat. No. 8,156,677 to Glock describes a firearm which includes an elongate removable backstrap that is selectively mountable to a grip of the firearm such that when mounted thereto, the effective size of the grip is increased. A pin used for mounting the backstrap can also secure a trigger mechanism housing to the receiver of the firearm.

U.S. Pat. No. 8,490,311 to Hogue discloses firearm grip assemblies for handguns. The firearm grip sleeve has retention features having a body including a central bore and a mating element, which enhance the functionality of standard factory-supplied firearm grips while remaining in a fixed position with respect to the firearm grip.

U.S. Pat. No. 7,587,852 to Harms describes a firearm handgun grip portion of a handgun frame with a forward grip portion and a rear grip portion with the rear grip portion having connecting means for removably connecting a plurality of removable and replaceable grip portions to the rear grip portion of the handgun frame through a sliding motion with a projecting rib portion on the handgun grip portion sliding into and out of slots, further the portions of the removable and replaceable grip portions are retained in a well to prevent them from spreading under pressure.

U.S. Patent Application. No. 2006/0096147 to Beretta discloses a grip of a gun that can be removably snap fitted in a rear portion of the body of the gun with reference to the trigger, the grip is adapted to envelop and at least partially cover a rear surface and at least portions of side surfaces of the body.

U.S. Patent Application. No. 2010/0139144 to Fitzpatrick et al. describes a modular handgrip for rifles, the handgrip features a base with a locking dovetail rail on opposite sides configured to receive a rail. Back strap and fore strap additions are provided capable of receiving the rail on the body. Also a storage compartment is provided inside the main body, accessible from a bottom of the grip.

U.S. Patent Application. No. 2012/0055060 to Hines et al. discloses a firearm handgrip that can be modified to accept an ergonomic insert that changes the palm relief of a firearm. The ergonomic insert can be releasable from the handgrip. A family of ergonomic inserts and a machining service can be offered to thereby provide firearms having interchangeable ergonomic inserts and thereby a customized and ergonomic grip.

U.S. Patent Application. No. 2013/0205635 to Hines et al. describes a removable grip insert for a modified handgun grip having an open cavity obtained by a planar removal of a portion of a rear wall of an original grip, where the original grip has backward-converging sidewalls and a magazine well with a flat back plate defining a cavity with the rear wall. The insert facilitates adjusting the size of the grip of a Glock handgun and a method for adapting such a grip to easily receive, accommodate, and secure the insert in place.

It is apparent now that numerous innovations for a grip for a rifle having interchangeable grip panels have been developed in the prior art that are adequate for various purposes. Furthermore, even though these innovations may be suitable for the specific purposes to which they address, accordingly, they would not be suitable for the purposes of the present invention as heretofore described. Thus a method and a system of a grip for an automatic rifles, including, but not limited to, AR-10 and AR-15 rifles, having a skeletonized frame that mates with a lower receiver of the rifle and including reinforced frame members for enhancing structural integrity of the grip, an opening for storing items, and interchangeable grip panels for altering the visual and functional aspects of the grip is needed.

SUMMARY OF THE INVENTION

The present invention discloses a skeletonized grip having interchangeable grip panels. With the above-noted prior art and inadequacies in mind, it is an object of the present invention to provide a grip for automatic rifles, including, but not limited to, AR-10 and AR-15 rifles, having a skeletonized frame that mates with a lower receiver of the rifle and including reinforced frame members for enhancing structural integrity of the grip, an open area for storing items pertinent to operation of the automatic rifle, and interchangeable grip panels for altering the visual and functional aspects of the grip.

In view of the foregoing, it is therefore an object of the present invention to provide an improved skeletonized grip having interchangeable grip panels for an automatic firearm at least for an AR-10 or AR-15 automatic rifle.

It is another object of the present invention to provide a skeletonized frame comprising plurality of frame members disposed at interconnecting angles for reinforcing structural integrity to form a substantially unitary body extending about and defining at least an open area for storing at least one item pertinent to operation of the automatic firearm.

It is another object of the present invention to provide recessed perimeter on the skeletonized frame to enables the grip panels to couple with the skeletonized frame without exposing the edges of the grip panels, so as to at least protect the edges from damage from inadvertent impact and abrasion.

It is still another object of the present invention to provide interchangeable grip panels, so as to at least interchange texture, colors, material, shape and size of the grip panels to suit the user and the application.

It is further another object of the present invention to provide a grip which is inexpensive to manufacture, easy and quick to assemble and having structural integrity, storage capacity, and interchangeable panels.

In accordance with one aspect of the present invention, a grip for an automatic firearm having interchangeable grip panels, wherein the grip comprising, a skeletonized frame a forward grip panel, a left grip panel, a right grip panel and at least one alignment pin, wherein the skeletonized frame comprising plurality of frame members disposed at interconnecting angles for reinforcing structural integrity to form a substantially unitary body extending about and defining at least an open area, the skeletonized frame further comprising a receiver end, a base end, forward side, a rearward side, a left side, and a right side, wherein a receiver slot on the the receiver end of the skeletonized frame enables aligned and secure attachment with the automatic firearm; further the forward panel comprising a forward panel edge, the forward panel is configured to interchangeably couple with the forward side of the skeletonized frame; wherein, the left panel comprising a left panel edge and at least one left alignment hole, the left panel is configured to interchangeably couple with the left side of the skeletonized frame; further, the right panel comprising a right panel edge and at least one right alignment hole, the right panel is configured to interchangeably couple with the right side of the skeletonized frame; wherein, at least one recessed perimeter on the forward side, left side and right side enables the respective panels to couple with the skeletonized frame without exposing their edges; and at least one alignment pin is configured to pass through the left alignment hole and the right alignment hole for aligning the left panel to the right panel.

In another aspect of the invention, the grip panels comprise at least one operational switch configured to operate at least one component of the automatic rifle, wherein the operational switch may include, without limitation, switches for powering on and off, light switch, laser switch, and GPS tracking receivers/transmitters.

In another aspect of the invention, the open area in the skeletonized frame is configured to contain at least one item pertinent to operation of the automatic rifle, wherein the item may include bullets, lighters, an emergency GPS transponder and additional weight to balance the automatic rifle.

In another aspect of the invention, the skeletonized frame may further comprise an attachment hole in the receiver end to align and connect the receiver end with a detent in the lower receiver of the automatic firearm and the skeletonized frame further comprises a safety slot.

In another aspect of the invention, the material composition of the skeletonized frame may include, without limitation, lightweight metal alloys, wood, carbon fibers, and epoxy resins.

In another aspect of the invention, the forward panel, left panel and right panel comprise at least one forward aperture, left aperture and right aperture respectively on their face so as to enable passage of fasteners through the apertures to secure the panels to the skeletonized frame.

In another aspect of the invention, the grip further includes a rearward panel, wherein the rearward panel is configured to detachably mate with the rearward side of the skeletonized frame, wherein the rearward panel may be cushioned to absorb recoil forces from discharge of the automatic rifle. Further the rearward panel may be cushioned to absorb recoil forces from discharge of the automatic rifle.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
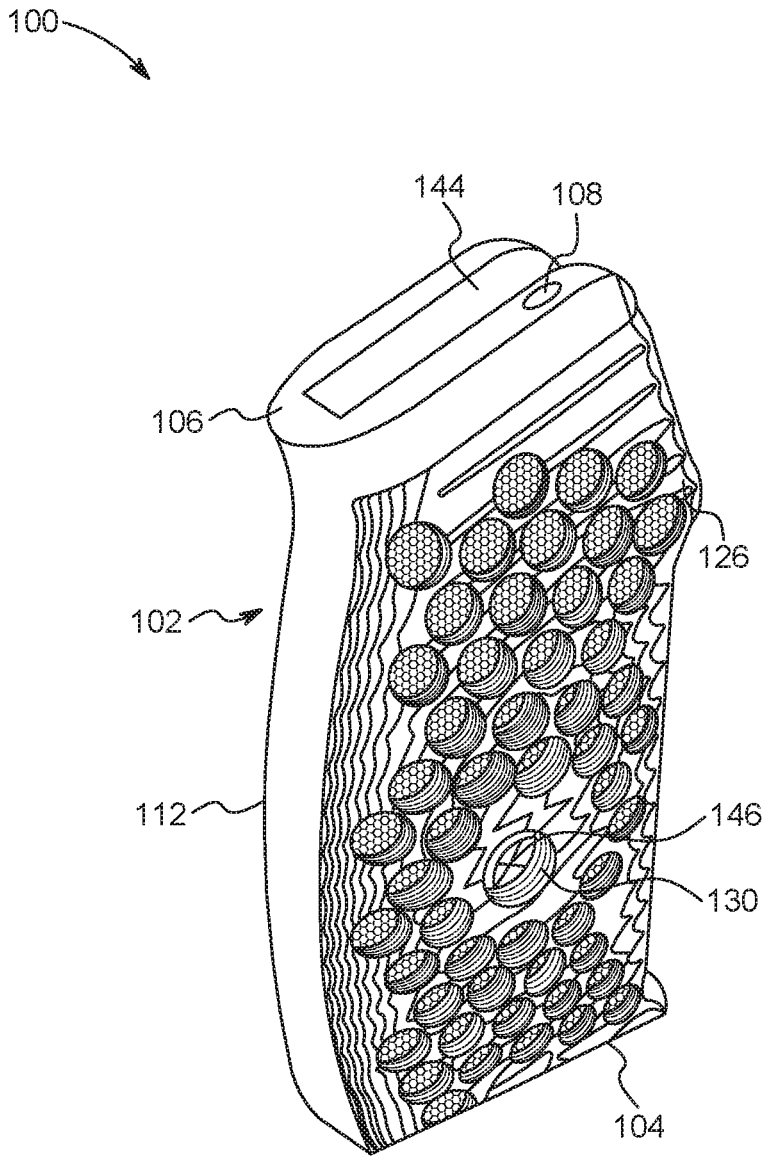
FIG. 1 illustrates a perspective view of an exemplary grip with an interchangeable left panel, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rearward," "right," "forward," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A grip 100 for an automatic rifle formed from a skeletonized frame 102 that receives interchangeable panels 120, 126, 136 is referenced in FIGS. 1-5. In some embodiments, the present invention teaches a grip 100 for an AR-10 and AR-15 automatic rifle (not shown). Though in other embodiments, the grip 100 may be used with any rifle known in the art. The grip 100 is formed substantially from a skeletonized frame 102 that mates with the receiver of the automatic rifle. The skeletonized frame 102 provides a surface for manipulating and operating the automatic rifle. The configuration of the skeletonized frame 102 includes a plurality of frame members 118 that interconnect at angles to reinforce the structural integrity of the skeletonized frame 102. The frame members 118 integrally join to form a substantially unitary body extending about and defining an open area 154. The open area 154 may store at least one item pertinent to operation of the automatic rifle (not shown).

As referenced in FIG. 1, the skeletonized frame 102 is configured to receive multiple interchangeable panels 120, 126, 136 for altering the visual and functional aspects of the grip 100. The interchangeable panels120, 126, 136 recess into an appropriate section of the frame, such that the edges 122, 128, 138 of the interchangeable panels 120, 126, 136 are protected from damage from inadvertent impact and abrasion. In one embodiment, the grip panels 120, 126, 136 provide a texture that helps cushion the palm of the hand during operation of the rifle. In another embodiment, the panels 120, 126, 136 interchange to accommodate left hands and/or right hands. In another embodiment, the panels 120, 126, 136 include operational switches for powering on and off, and operating auxiliary components of the rifle, such as lights, lasers, and GPS tracking. In yet another embodiment, the panels 120, 126, 136 provide decorative effect, such as texture and color, for aesthetics, identification, or camouflage.

Those skilled in the art, in light of the present teachings, will recognize that users of the automatic rifle have different sizes add shaped hands. Automatic rifles are normally manufactured and are sold, however, with only one size, shape and style of a grip. An improper size, shape and style of grip can make the automatic rifle uncomfortable to shoot, make it difficult to shoot accurately, and can even make the automatic rifle unsafe to handle. Further, some users may desire a comparatively soft grip that has some give to it; and yet other uses may prefer a more rigid grip. Further, some users may require a comparatively smooth grip; and other users may prefer a grip that has checkering or the like on the grip surface that provides friction between the hand and the grip. Thus, the interchangeability of the panels 120, 126, 136 in the present invention helps resolve many of these needs.

Figure 2:
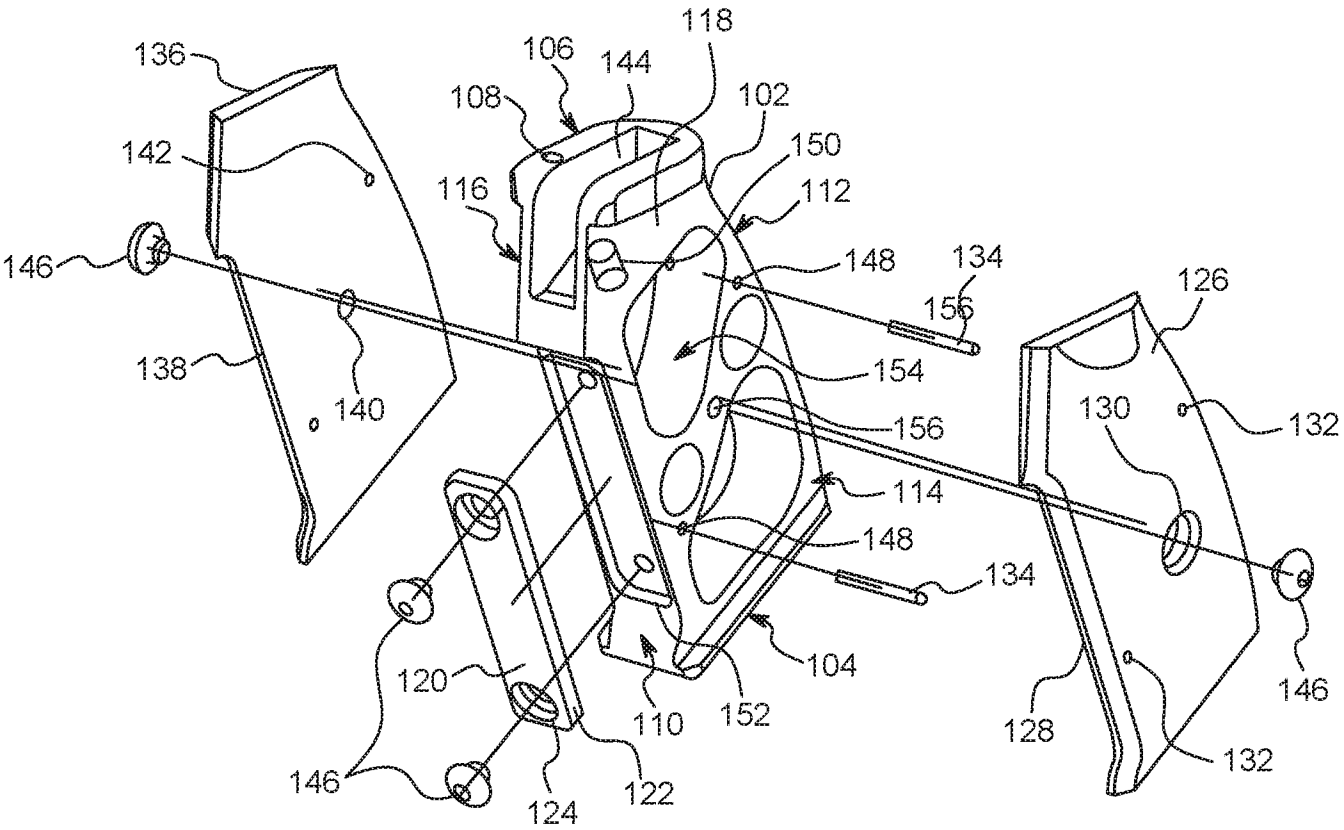
FIG. 2 illustrates a blow up view of the grip formed from an exemplary skeletonized frame for receiving an interchangeable forward panel, right panel, and left panel, in accordance with an embodiment of the present invention.

As referenced in FIG. 2, the grip 100 provides a skeletonized frame 102 and interchangeable panels 120, 126, 136. The skeletonized frame 102 comprises a substantially unitary body extending about and defining an open area 154. The skeletonized frame 102 may have a generally rectangular shape and dimensions efficacious for secure gripping of the automatic rifle during operation. The skeletonized frame 102 may further comprise a receiver end 106 for mating with an upper receiver of the automatic rifle. A receiver slot 144 on the receiver end 106 of the skeletonized frame 102 enables aligned and secure mating with the automatic rifle. An attachment hole 108 in the receiver end 106 also helps to align and connect the receiver end 106 with a detent in the lower receiver of the automatic firearm.

The skeletonized frame 102 may further comprise a base end 104 that is oppositely disposed to the receiver end 106. The skeletonized frame 102 may further comprise a forward side 110, a rearward side 112, a left side 114, and a right side 116 that are configured to receive a respective interchangeable panel 120, 126, 136. At least one recessed perimeter 152 on the forward side 110, rearward side 112, left side 114, and right side 116 enables the respective panels 120, 126, 136 to mate with the skeletonized frame 102 without exposing their edges 122, 128, 138. In one embodiment, the skeletonized frame 102 further comprises a safety slot 150 that enables access to a safety selector detent pin and spring, which is standard to the AR-15 automatic rifle and similarly designed automatic rifles.

Figure 3:
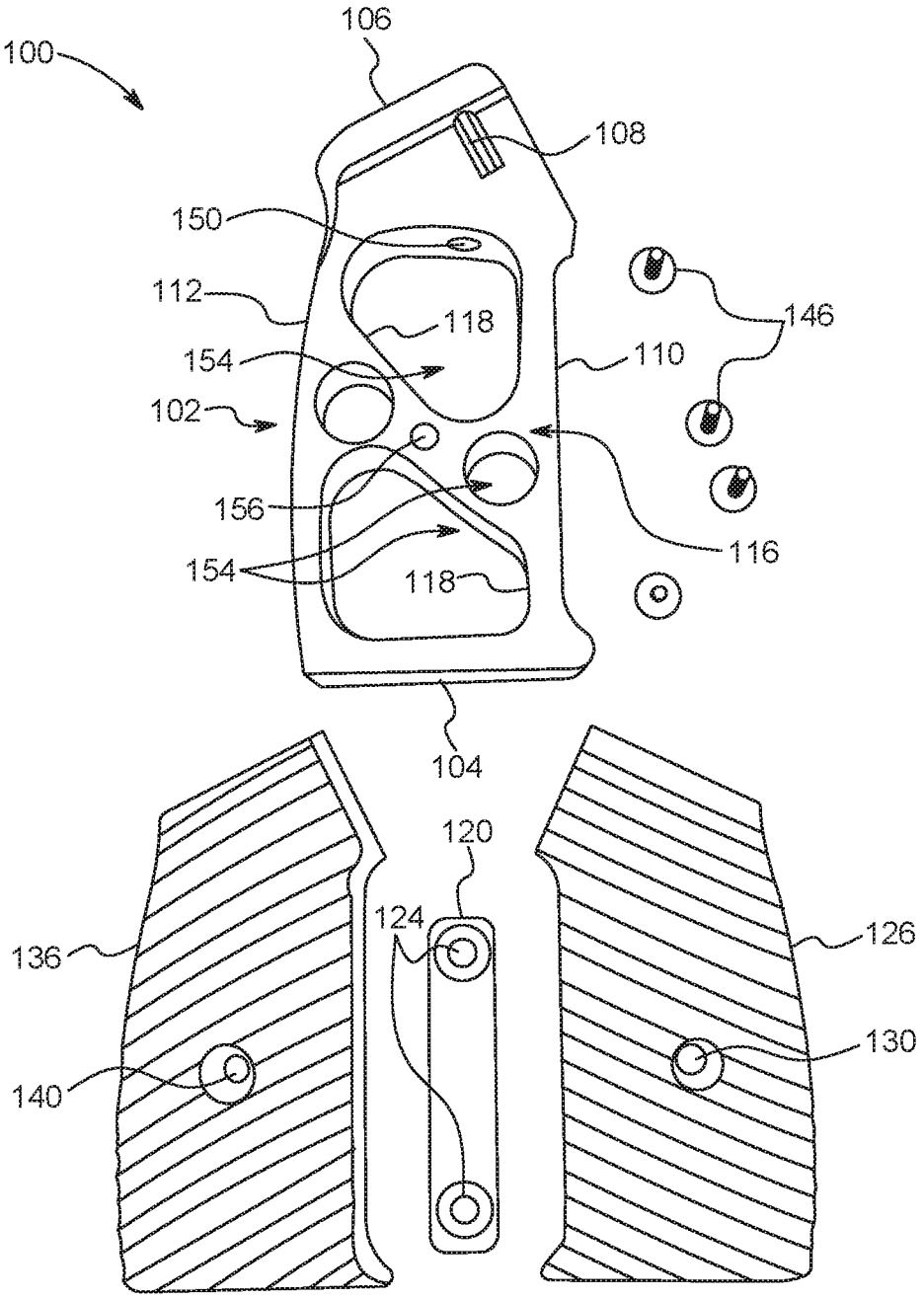
FIG. 3 illustrates a top view of the skeletonized frame, the forward panel, the right panel, the left panel, and the fasteners in accordance with an embodiment of the present invention.

Turning now to FIG. 3, the skeletonized frame 102 further comprises a plurality of frame members 118 disposed at interconnecting angles for reinforcing the structural integrity of the skeletonized frame 102. The frame members 118 form openings 154, slots 150, holes and recessed perimeter 152 for engagement with the panels 120, 126, 136 and for receiving at least one item into the opening 154. The item may include bullets, lighters, an emergency GPS transponder, and additional weight to balance the automatic rifle. The material composition of the skeletonized frame 102 may include, without limitation, lightweight metal alloys, carbon fibers, and epoxy resins.

Figure 4:
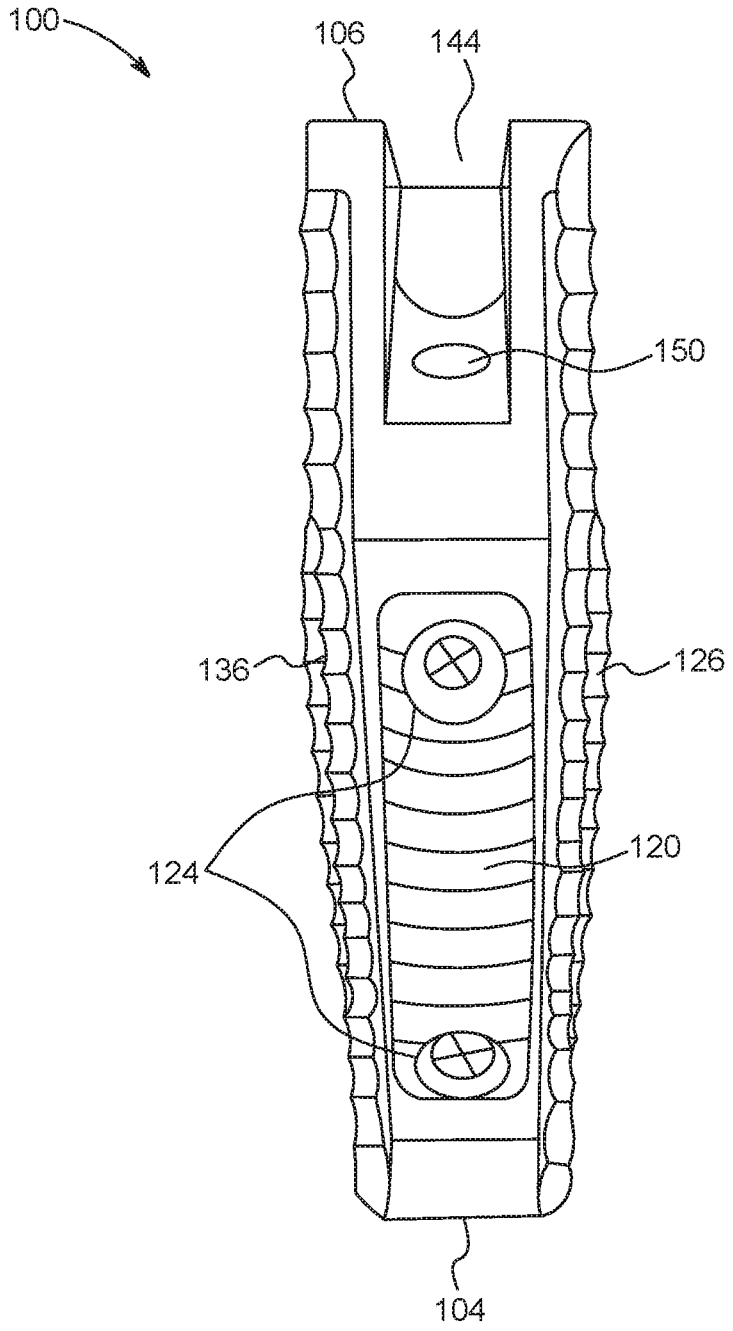
FIG. 4 illustrates a front perspective view of the skeletonized frame and the forward panel, in accordance with an embodiment of the present invention.

As illustrated in FIG. 4, the grip 100 may include a forward panel 120 defined by a forward panel edge 122. The forward panel 120 is configured to detachably mate with the forward side 110 of the skeletonized frame 102, wherein the forward panel 120 is configured to be interchanged with another forward panel. In one embodiment, at least one forward aperture 124 enables passage of at least one fastener 146 to detachably attach the forward panel 120 to the forward side 110 of the skeletonized frame 102. Though, in other embodiments, the forward panel 120 may detachably mate with the forward side 110 of the skeletonized frame 102 through a sliding rail, a frictional fit, or other fastening mechanism known in the art. The forward panel edge 122 recesses into at least one recessed perimeter 152 of the skeletonized frame 102 to protect against damage from inadvertent impact and abrasion. In one possible embodiment, the forward panel 120 may include an operational switch configured to operate auxiliary components of the automatic rifle. The operational switch may include, without limitation, light switch, laser switch, and GPS tracking receivers/transmitters.

Figure 5:
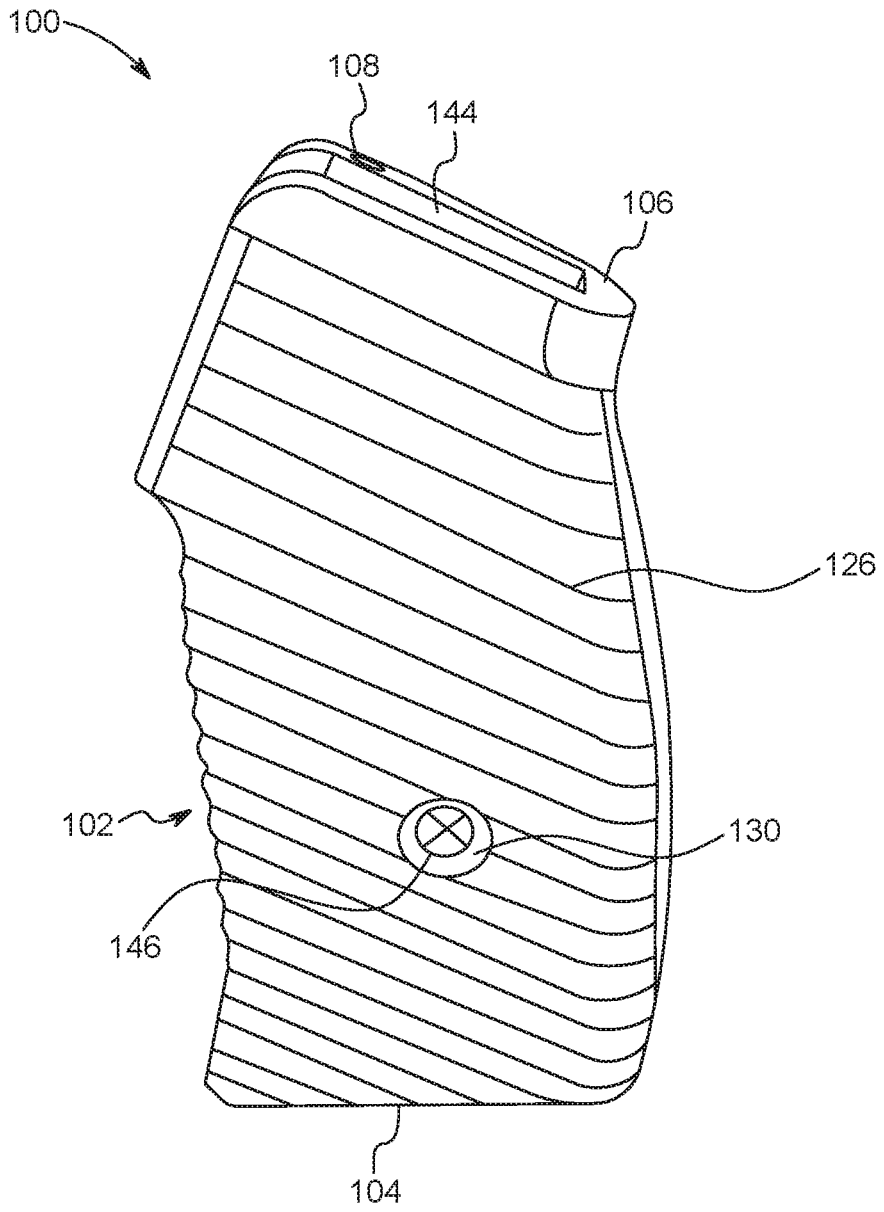
FIG. 5 illustrates a left side view of the skeletonized frame and the left panel, in accordance with an embodiment of the present invention.

Turning now to FIG. 5, the grip 100 may include a left panel 126 defined by a left panel edge 128. The left panel 126 is configured to detachably mate with the left side 114 of the skeletonized frame 102. In this manner, the left panel 126 is configured to be interchanged with another left panel. In one embodiment, at least one left aperture 130 enables passage of at least one fastener 146 to fasten the left panel 126 to a central aperture 156 (shown in FIG. 3) of the left side 114 of the skeletonized frame 102. Though, in other embodiments, the left panel 126 may detachably mate with the left side 114 of the skeletonized frame 102 through a sliding rail, a frictional fit, or other fastening mechanism known in the art. The left panel edge 128 recesses into the at least one recessed perimeter 152 of the skeletonized frame 102 to protect against damage from inadvertent impact and abrasion. The left panel 126 may further include at least one left alignment hole 132 that works in conjunction with an alignment pin 134 for proper alignment relative to the left side 114 of the skeletonized frame 102.

In some embodiments, the grip 100 may include a right panel 136 defined by a right panel edge 138. The right panel 136 is configured to detachably mate with the right side 116 of the skeletonized frame 102. In this manner, the right panel 136 is configured to be interchanged with another right panel 136. In one embodiment, at least one right aperture 140 enables passage of at least one fastener 146 to fasten the right panel 136 to the central aperture 156 (shown in FIG. 3) of the right side 116 of the skeletonized frame 102. Though, in other embodiments, the right panel 136 may detachably mate with the right side 116 of the skeletonized frame 102 through a sliding rail, a frictional fit, or other fastening mechanism known in the art.

Looking back at FIG. 2, the right panel edge 138 recesses into at least one recessed perimeter 152 of the skeletonized frame 102 to protect against damage from inadvertent impact and abrasion. The texture, colors, and material of the forward, left, and right panels 120, 126, 136 may be changed to suit the user and the application. For example, without limitation, the left and right panels 126, 136 may be interchanged to accommodate right handed, left handed and ambidextrous users of the automatic rifle.

The right panel 136 may further include at least one right alignment hole 142 to help align the right panel 136 with the right side 116 of the skeletonized frame 102 and the left panel 126. An alignment pin 134 passes through the right alignment hole 142, the frame alignment hole 148, and the left alignment hole 132. The frame alignment hole 148 in the body of the skeletonized frame 102 enables passage of the alignment pin 134 in this manner. Through use of the alignment pin 134, the left and right panels 126, 136 may be aligned in relation to their respective sides on the skeletonized frame 102.

In one embodiment of the present invention as referenced in FIGS. 1-5, a grip 100 with interchangeable grip panels 120, 126, and 136, wherein the grip 100 comprising, a skeletonized frame102, a forward grip panel 120, a left grip panel 126, a right grip panel 136 and at least one alignment pin 134, wherein the skeletonized frame 102 having a plurality of frame members 118 disposed at interconnecting angles for reinforcing structural integrity to form a substantially unitary body extending about and defining at least an open area 154, the skeletonized frame 102 further comprising a receiver end 106, a base end 104, forward side 110, a rearward side 112, a left side 114, and a right side 116; further the forward panel 120 comprising a forward panel edge 122, the forward panel 120 is configured to interchangeably couple with the forward side 110 of the skeletonized frame 102; wherein, the left panel 126 comprising a left panel edge 128 and at least one left alignment hole 132, the left panel 126 is configured to interchangeably couple with the left side 114 of the skeletonized frame 102; further the right panel 136 comprising a right panel edge 138 and at least one right alignment hole 142, the right panel 136 is configured to interchangeably couple with the right side 116 of the skeletonized frame 102; wherein, at least one recessed perimeter 152 on the forward side 110, left side 114 and right side 116 of the skeletonized frame 102 enables the respective panels 120, 126 and 136 to couple with the skeletonized frame 102 without exposing their edges 122, 128 and 138; and the at least one alignment pin 134 is configured to pass through the left alignment hole 132 and the right alignment hole 142 for aligning the left panel 126 to the right panel 136.

In one alternative embodiment, the grip 100 may further include a rearward panel that detachably mates with the rearward side 112 of the skeletonized frame 102, wherein the rearward panel is configured to be interchanged with another rearward panel. The rearward panel may be cushioned to absorb recoil forces from discharge of the automatic rifle.

In another embodiment of the present invention as referenced in FIGS. 1-5, a grip 100 for an automatic rifle having interchangeable grip panels, wherein the grip 100 comprising, a skeletonized frame102, a forward grip panel 120, a rearward grip panel (not shown), a left grip panel 126, a right grip panel 136 and at least one alignment pin 134, wherein the skeletonized frame 102 having a plurality of frame members 118 disposed at interconnecting angles for reinforcing structural integrity to form a substantially unitary body extending about and defining at least an open area 154, the skeletonized frame 102 further comprising a receiver end 106, a base end 104, forward side 110, a rearward side 112, a left side 114, and a right side 116; wherein a receiver slot 144 on the receiver end 106 of the skeletonized frame 102 enables aligned and secure mating with the automatic rifle and an attachment hole 108 in the receiver end 106 helps to align and connect the receiver end 106 with a detent in the lower receiver of the automatic rifle (not shown) and further the skeletonized frame 102 comprises a safety slot 150; wherein the forward panel 120 comprising a forward panel edge 122 and a forward aperture 124 facilitating interchangeable attachment of the forward panel 122 with the forward side 110 of the skeletonized frame 102; the left panel 126 comprising a left panel edge 128, left aperture 130 and at least one left alignment hole 132 facilitating interchangeable attachment of the left panel 126 with the left side 114 of the skeletonized frame 102; the right panel 136 comprising a right panel edge 138, right aperture 140 and at least one right alignment hole 142 facilitating interchangeable attachment of the right panel 136 with the right side 116 of the skeletonized frame 102; wherein, and the rearward panel (not shown) comprising a rearward panel edge and a rearward aperture facilitating interchangeable attachment of the rearward panel with the rearward side 112 of the skeletonized frame 102; wherein, at least one recessed perimeter 152 on the forward side 110, rearward side 112, left side 114 and right side 116 enables the respective panels to mate with the skeletonized frame 102 without exposing their edges; at least one alignment pin 134 configured to pass through the left alignment hole 132 and the right alignment hole 142 through the frame alignment hole 148 for aligning the left panel 126 and the right panel 136 to the skeletonized frame 102; and fasteners 146 to fasten the forward panel 120, the rearward panel (not shown), the left panel 126 and the right panel 136 to the skeletonized frame 102 at their respective apertures.

One objective of the present invention is to provide a grip 100 that mates with an AR-10 or AR-15 automatic rifle and provides interchangeable grip panels 120, 126, 136.

Another objective is to provide structural integrity through a skeletonized frame 102 having reinforcing frame members 118.

Yet another objective is to protect the edges 122, 128, 138 of the panels 120, 126, 136 by recessing the edges into the skeletonized frame 102.

Yet another objective is to interchange texture, colors, and material of the forward, left, and rearward panels 120, 126, 136 to suit the user and the application.

Yet another objective is to provide storage for at least one item in the skeletonized frame 102.

Yet another objective is to provide an inexpensive to manufacture grip 100 having structural integrity, storage capacity, and interchangeable panels 120, 126, 136.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A grip with interchangeable grip panels, wherein the grip comprises:

a skeletonized frame, the skeletonized frame comprising plurality of frame members disposed at interconnecting angles for reinforcing structural integrity to form a substantially unitary body extending about and defining at least an open area, the skeletonized frame further comprising a receiver end, a base end, forward side, a rearward side, a left side, and a right side;

a forward panel, wherein the forward panel comprising a forward panel edge, the forward panel is configured to interchangeably couple with the forward side of the skeletonized frame;

a left panel, the left panel comprising a left panel edge and at least one left alignment hole, the left panel is configured to interchangeably couple with the left side of the skeletonized frame;

a right panel, the right panel comprising a right panel edge and at least one right alignment hole, the right panel is configured to interchangeably couple with the right side of the skeletonized frame;

wherein, at least one recessed perimeter on the forward side, left side and right side of the skeletonized frame enables the respective panels to couple with the skeletonized frame without exposing their edges; and at least one alignment pin, wherein the alignment pin is configured to pass through the left alignment hole and the right alignment hole for aligning the left panel to the right panel.

2. The grip of claim 1, wherein the skeletonized frame is configured to mate with a receiver of an automatic firearm.

3. The grip of claim 1, wherein the open area in the skeletonized frame is configured to contain at least one item that facilitates operation of an automatic firearm, wherein the item includes bullets, lighters, a global positioning system (GPS) transponder additional weight to balance the automatic rifle.

4. The grip of claim 1, wherein the skeletonized frame further comprises a receiver slot on the receiver end of the skeletonized frame enables aligned and secure attachment with an automatic firearm.

5. The grip of claim 1, wherein the material composition of the skeletonized frame includes lightweight metal alloys, carbon fibers, and epoxy resins.

6. The grip of claim 1, wherein one or more of the grip panels comprise at least one operational switch, wherein the operational switch includes switches for powering on and off, light switch, laser switch, and GPS tracking receivers/transmitters.

7. A grip for an automatic firearm having interchangeable grip panels, wherein the grip comprises:

a skeletonized frame, the skeletonized frame comprising plurality of frame members disposed at interconnecting angles for reinforcing structural integrity to form a substantially unitary body extending about and defining at least an open area, the skeletonized frame further comprising a receiver end, a base end, forward side, a rearward side, a left side, and a right side, wherein a receiver slot on the receiver end of the skeletonized frame enables aligned and secure attachment with the automatic firearm;

a forward panel, wherein the forward panel comprising a forward panel edge, the forward panel is configured to interchangeably couple with the forward side of the skeletonized frame;

a left panel, the left panel comprising a left panel edge and at least one left alignment hole, the left panel is configured to interchangeably couple with the left side of the skeletonized frame;

a right panel, the right panel comprising a right panel edge and at least one right alignment hole, the right panel is configured to interchangeably couple with the right side of the skeletonized frame;

wherein, at least one recessed perimeter on the forward side, left side and right side of the skeletonized frame enables the respective panels to couple with the skeletonized frame without exposing their edges; and at least one alignment pin, wherein the alignment pin is configured to pass through the left alignment hole and the right alignment hole for aligning the left panel to the right panel.

8. The grip of claim 7, wherein the automatic firearm is an automatic rifle.

9. The grip of claim 7, wherein the open area in the skeletonized frame is configured to contain at least one item that facilitates operation of the automatic firearm, wherein the item includes bullets, lighters, an emergency GPS transponder and an additional weight to balance the automatic firearm.

10. The grip of claim 7, wherein the skeletonized frame further comprises an attachment hole in the receiver end to align and connect the receiver end with a detent in the lower receiver of the automatic firearm.

11. The grip of claim 7, wherein the material composition of the skeletonized frame includes lightweight metal alloys, carbon fibers, and epoxy resins.

12. The grip of claim 7, wherein the forward panel, the left panel and the right panel comprise at least one forward aperture, a left aperture and a right aperture respectively on their face so as to enable passage of fasteners through the apertures to secure the panels to the skeletonized frame.

13. The grip of claim 7, wherein one or more of the grip panels comprise at least one operational switch configured to operate at least one component of the automatic firearm, wherein the operational switch includes switches for powering on and off, light switch, laser switch, and GPS tracking receivers/transmitters.

14. The grip of claim 7, the grip further includes a rearward panel, wherein the rearward panel is configured to detachably mate with the rearward side of the skeletonized frame, wherein the rearward panel may be cushioned to absorb recoil forces from discharge of the automatic firearm.

15. A grip for an automatic rifle having interchangeable grip panels, wherein the grip comprises:

a skeletonized frame, the skeletonized frame comprising plurality of frame members disposed at interconnecting angles for reinforcing structural integrity to form a substantially unitary body extending about and defining at least an open area, the skeletonized frame further comprising a receiver end, a base end, forward side, a rearward side, a left side, and a right side, wherein a receiver slot on the receiver end of the skeletonized frame enables aligned and secure mating with the automatic rifle and an attachment hole in the receiver end helps to align and connect the receiver end with a detent in the lower receiver of the automatic;

a forward panel, wherein the forward panel comprising a forward panel edge and a forward aperture to facilitate mounting an interchangeable attachment of the forward panel with the forward side of the skeletonized frame;

a left panel, the left panel comprising a left panel edge, left aperture and at least one left alignment hole facilitating interchangeable attachment of the left panel with the left side of the skeletonized frame;

a right panel, the right panel comprising a right panel edge, right aperture and at least one right alignment hole facilitating interchangeable attachment of the right panel with the right side of the skeletonized frame;

a rearward panel, the rearward panel comprising a rearward panel edge and a rearward aperture facilitating interchangeable attachment of the rearward panel with the rearward side of the skeletonized frame;

wherein, at least one recessed perimeter on the forward side, rearward side, left side and right side of the skeletonized frame enables the respective panels to mate with the skeletonized frame without exposing their edges;

at least one alignment pin, the alignment pin configured to pass through the left alignment hole and the right alignment hole through a frame alignment hole for aligning the left panel and the right panel to the skeletonized frame; and fasteners to fasten the forward panel, the rearward panel, the left panel and the right panel to the skeletonized frame at their respective apertures.

16. The grip of claim 15, wherein the automatic rifle is a lightweight, magazine-fed, gas-operated automatic rifle.

17. The grip of claim 15, wherein the open area in the skeletonized frame is configured to contain at least one item that facilitates operation of the automatic rifle, wherein the item includes bullets, lighters, an emergency GPS transponder and additional weight to balance the automatic rifle.

18. The grip of claim 15, wherein the material composition of the skeletonized frame includes lightweight metal alloys, carbon fibers, and epoxy resins.

19. The grip of claim 15, wherein one or more of the grip panels comprises an operational switch configured to operate a component of the automatic rifle, wherein the operational switch includes switches for powering on and off, light switch, laser switch, and GPS tracking receivers/transmitters.

20. The grip of claim 15, wherein the rearward panel cushioned to absorb recoil forces from discharge of the automatic rifle.

* * * * *